US005645089A

United States Patent [19]

Burger et al.

[11] Patent Number: 5,645,089

[45] Date of Patent: Jul. 8, 1997

[54] PREPARATORY MATERIALS FOR AN ARTICLE FOR SMOKING AND A SLEEVE SECTION THEREFOR

[75] Inventors: Christian Burger; Beat Burger, both of Burg, Switzerland

[73] Assignee: Burger Soehne AG Burg, Burg, Switzerland

[21] Appl. No.: 209,435

[22] Filed: Mar. 10, 1994

[30] Foreign Application Priority Data

Mar. 13, 1993 [CH] Switzerland ..... 00745/93

[51] Int. Cl.[6] ..... A24D 1/02

[52] U.S. Cl. ..... 131/365; 131/105

[58] Field of Search ..... 131/365, 105

[56] References Cited

U.S. PATENT DOCUMENTS 859,038 12/1907 Baird ..... 131/365

1,257,815 2/1918 Courtinade ..... 131/365

1,289,975 7/1918 Waddell ..... 131/365

OTHER PUBLICATIONS

European Search Report for application No. EP 94 10 3009.

*Primary Examiner*—Vincent Millin

*Assistant Examiner*—Charles W. Anderson

*Attorney, Agent, or Firm*—McCormick, Paulding & Huber

[57] ABSTRACT

The present invention provides prepared materials for making a hand rolled smoking article and a sleeve section for such an article. The materials include a sleeve section having a tube-shaped sleeve and a filler made from finely cut tobacco. The sleeve section is manufactured from tobacco leaf or foil and includes a substantially rectangular base part which receives the filler and a wrapper part connected to one long side of the rectangular base part. The wrapper part is defined by a substantially straight line continuation of a short side of the rectangle and a line projecting at an angle to the above-referenced long side from an opposite corner of the rectangle to make the straight line continuation.

5 Claims, 1 Drawing Sheet

1
2
3
4
5
6
7
8
9
11

1
2
3
4
5
6
7
8

7
20

1'
4
5
6
7'
8
3
9'

PREPARATORY MATERIALS FOR AN ARTICLE FOR SMOKING AND A SLEEVE SECTION THEREFOR

BACKGROUND OF THE INVENTION

The present invention relates to prepared materials for an article for smoking which is hand rolled by the smoker and includes a sleeve section rolled into a tube-shaped sleeve and a filler made of tobacco.

Smoking articles with tube-shaped sleeves are generally known as cigars, cigarillos and cigarettes. Cigars consist of a tobacco filler, a surrounding wrapper holding the tobacco together and an exterior cover or wrapper; one differentiates between hand rolled and machined-manufacture types. The first are produced in special factories in which the rolling by hand requires years of practice and great dexterity. The filler always consists of selected whole, half or quartered tobacco leaves (so called "long filler"). With the manufacture of cigars by machine a chopped or short length tobacco ("short filler") is used as the filler. Likewise, the machine manufactured short filler products are cigarillos and short cigars which are produced continuously as strands or individually and are cut to length. Finally cigarettes consist of fine tobacco cuttings in a tube-shaped paper sleeve.

Apart from machine manufactured cigarettes, cigarette tobaccos and cigarette papers in packages have for a long time been available for the smoker to roll his own cigarettes by hand and in some cases with the aid of simple assisting devices. By this means the smoker rolls a portion of the cigarette tobacco in a rectangular cigarette paper and then glues the paper along its lengthwise edge. For such products a long-standing and important question is whether the self-rolled cigarettes provide the individual with smoking pleasure comparable to the ready-made cigarettes in packages and also do they offer considerable price value?

Cigarette smoking is naturally differentiated from cigar or pipe smoking in that it is not concerned with pure tobacco consumption: the cigarette paper impairs at least the tobacco aroma and can, additionally, have other influences to which the smoker himself as well as passive smokers take exception.

On account of this, there is an effort, at least for the smoker who rolls his own cigarettes, to replace the cigarette paper with a tobacco product. Such attempts however have shown that it is not fruitful to manually make a stable cigarette-like product out of cigarette tobacco (fine cuttings) for the filler and a sleeve section out of tobacco substantially in the shape of cigarette paper. In particular, in order to be able to roll a tobacco leaf it must have a specific moisture content, and when in this condition, it reacts entirely differently than a leaf of paper. The later allows itself to be readily rolled by hand in a "dry" condition and lends the necessary stability to the product.

It is accordingly an object of the present invention to make possible the rolling of a cigarette-like product by the smoker in the customary manner, which product, however, does not require a paper sleeve but instead consists entirely of tobacco.

SUMMARY OF THE INVENTION

Departing from the prepared materials of the above-mentioned type, this objective is achieved, according to the present invention, by means of a sleeve section produced from a tobacco leaf or a tobacco foil (homogenized tobacco leaf, "HTL") and a filler from a finely cut tobacco (cigarette tobacco). The sleeve section has a substantially rectangular base part receiving a filler and a wrapper part connecting with one long side of the rectangle. The length of the base part determines the corresponding length of the sleeve to be rolled, and the width (short side of the rectangle) corresponds at least to the sleeve circumference. The wrapper part of the sleeve section is on the one hand defined by a straight line which is a continuation of the short side of the rectangle, and on the other hand by a line which projects from one oppositely disposed corner of the base part and extends at an acute angle to the aforementioned long side of the rectangle.

The invention also relates to the novel sleeve section itself.

With such prepared materials or material assortment according to the invention, the smoker surprisingly can manage to roll in the customary manner a "solid" smoking article substantially in the form of a cigarette, however, the article is made exclusively out of tobacco material and also is rolled free hand. The required stability—during rolling as well as smoking afterward—is achieved substantially through the shape of the sleeve section in which the referenced acute-angle-extending edge line after rolling follows a helical line extending around the wrapper or correspondingly around the filler. Along this line a strong attachment (also without glue) additionally takes place practically by itself. This prevents the intake of "false air" and guarantees smooth burning during smoking.

The invention additionally makes possible the individual, pure tobacco smoking of self rolled smoking articles. From combinations of tobacco types dictated for the sleeve section and for the filler, the smoker selects and varies the desired aroma and obtains the sought after repeatability better than through mixing various types of tobacco in the filler alone. If desired a simple assisting device can also be employed (similar to those used with cigarette rolling); however, the rolling is accomplished free hand without more, that is, without support.

BRIEF DESCRIPTION OF THE DRAWINGS

The invention is described further below with the aid of exemplary embodiments in combination with the following drawings.

DESCRIPTION OF THE PREFERRED EMBODIMENTS

Figure 1:
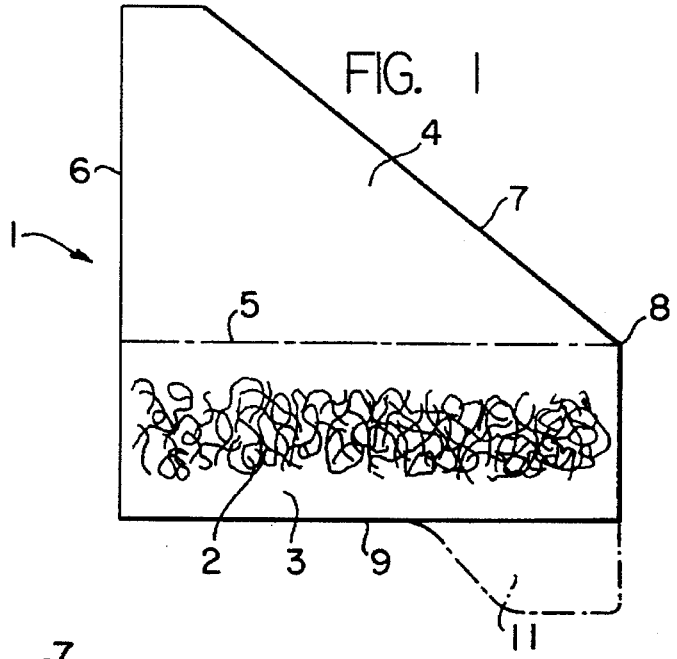
FIG. 1 shows a flat, spreadout sleeve section with the filler on the base part.
Figure 2:
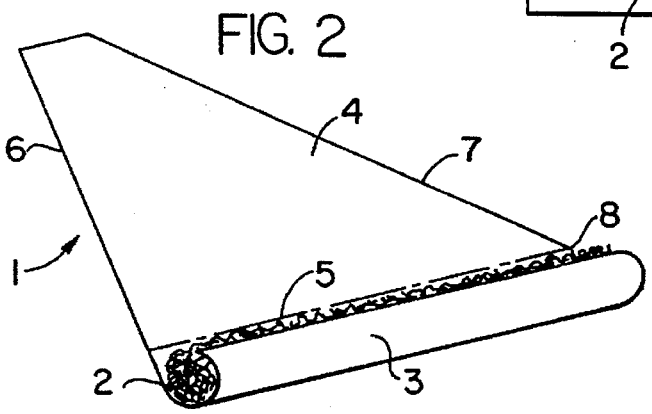
FIG. 2 shows the arrangement according to FIG. 1 in perspective at the beginning of rolling the smoking article.
Figure 3:
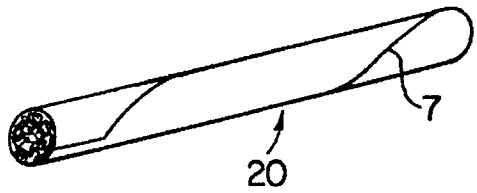
FIG. 3 is a view of the rolled article when finished.

The procedure of "rolling" a smoking article 20 (FIG. 3) by a smoker himself is shown in FIGS. 1–3.

It starts with a spread out sleeve section 1 having an approximately rectangular base part 3 and a wrapper part 4 which connects to a long side of the rectangle of the base part 3. On the base part 3 the smoker spreads a portion of a finely cut tobacco (so called fine cuttings or cigarette tobacco) as a filler. Then he begins to roll the filler 2 on the base part 3 into a shaftlike form (FIG. 2) that normally is accomplished freehand between the fingers of both hands. With continued rolling the wrapper part 4 also overlies the filler 2 in the base part 3, that is, the whole sleeve section 1 is rolled into a tube shaped sleeve. The length of the base part 3, that is the length of the long side 5, determines the length of the sleeve and correspondingly the length of the article 20. The width of the base part 3, that is the length of the short side of the rectangle, should correspond at least to the sleeve circumference (this can naturally vary somewhat with rolling according to the amounts of filler and its density). In practice it has been shown that a length of approximately 60–100 mm and a width of the base part of approximately 25–35 or 40 mm is adequate to produce a smoking article 20 that is marketable. The rolling of the tobacco filler 2 together with a filter piece (not illustrated) is left to the smoker.

The sleeve section 1 is preferably cut out of naturally grown tobacco leaves fermented and prepared in a known manner (while avoiding the leaf ribs). It is also possible, however, to utilize tobacco foils manufactured from finely ground tobaccos (homogenized tobacco leaf "HTL"). The material must be sufficiently damp so that it is not brittle and does not break during rolling. For this reason a hygroscopic impregnation known for tobacco products, for example a glycerin preparation, can be used. A number of sleeve sections can be combined into a marketable unit in which a moisture retaining packaging is recommended for storage and distribution. The sleeve section and finely cut tobacco for the filler can naturally be combined in a marketable package.

The further features of the sleeve section 1 are described now with the aid of FIG. 1. As already mentioned the rectangular base part 3 and the wrapping part 4 are connected together at the one long side 5 of the rectangle. The wrapping part 4 is limited on the one hand by a (more or less) straight line 6 which extends as a continuation of the one short side of the rectangle. When finished the region along the line 6 in the rolled article forms the mouthpiece end of the tube shaped sleeve (left in FIG. 3). On the other end the wrapper part 4 is limited by a line 7 which projects from an opposite corner 8 of the base part 3 and extends at an acute angle (in a suitable manner at an angle of approximately 25°–50° ) to the above mentioned long side 5 of the rectangle. This line 7 forms a helical line on the tube shaped rolled sleeve as it is seen in FIG. 3. At the end which forms the corner 8 (the right side in FIG. 3) the article 20 is lit during smoking.

Thanks essentially to the upper part 4 bent around the filler 2 and the base part 3, the sleeve 1 generates the necessary stability during rolling and afterward during smoking. Without the use of special care during rolling, the sleeve permits the edge region along the line 7 to conform satisfactorily to the underlying sleeve portion so that uniform burning takes place during smoking. Naturally the smoker can lightly dampen the edge along the line 7 before rolling. The application of an adhesive although certainly possible is not generally necessary.

In the framework of the described features of the sleeve section 1, certain variations are possible. So, for example it may be useful to provide a flap or extension 11 projecting from the outer long side 9 of the rectangle as indicated by dotted lines in FIG. 1 and, to be sure, in the region of the same end where the corner 8 is. Such a flap 11 can also facilitate the start of rolling of the base part along the side 9.

Figure 4:
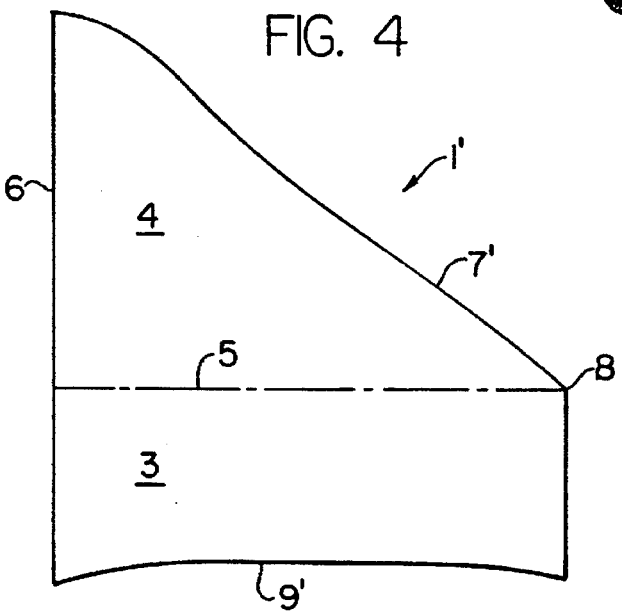
FIG. 4 shows one possible variation in the shape of the sleeve section.

In FIG. 4 a sleeve section 1' is illustrated with a further variation in the shape of its contour. Accordingly, the line 7'—substantially as the line 7 in FIG. 1 is inclined to line 5—can extend somewhat in a wavy manner, for example with a bulge, and run also to the tip of the line 6. Further, the outer long side of the rectangle of the base part 3 can be somewhat curved along the line 9'. Finally, (although not specifically illustrated) the line 6 also can deviate from a perfectly straight line by means of a slight curve. Just as in FIG. 1 so also in FIG. 4 the tip angle formed by the line 7 (correspondingly 7') and the rectangle side 5 substantially determines the length of the line 6 above the side 5; as a rule here it is also valid to say that the wrapper part along the line 6 should wrap around the rolled base part at least approximately once and preferably 1.5 to at maximum approximately 2.5 times.

It should also be mentioned that the sleeve section 1 (or 1') can be rolled inwardly of the one or the other flat surfaces. In other words, the sleeve section can confine the filler 2 either in the position according to FIG. 1 or in the mirror-image position rotated about the line 6.

We claim:

1. Prepared materials for making a hand-rolled smoking article, said materials comprising a sleeve section having a tube shaped sleeve and a filler made from tobacco, said materials characterized in that:

the filler consists of finely cut tobacco; and the sleeve section is manufactured from tobacco leaf or a tobacco foil and includes a substantially rectangular base part which receives the filler and a wrapper part which connects to one long side of the rectangle of the base part, in which the length of the base part and correspondingly the referenced long side of the rectangle determine the length of the sleeve and the width of the rectangle corresponds at least to the sleeve circumference, and in which the wrapper part is defined on the one hand by a straight line which is a continuation of the short side of the rectangle and on the other hand by a line which projects from an opposite corner of the base part and extends at an acute angle to the referenced long side of the rectangle.

2. A sleeve section for a hand-rolled article for smoking, said article including a tube-shaped sleeve rolled from the sleeve section and a filler made of tobacco, said sleeve section characterized in that the sleeve section is manufactured from a tobacco leaf or tobacco foil and has a substantially rectangular base part and a wrapper part connected to one long side of the rectangle of the base part, said base part receiving the tobacco filler for rolling, and the wrapper part being defined by a substantially straight line continuation of a short side of the rectangle and a line projecting at an angle to the referenced long side from an opposite corner of the rectangle to meet the straight line continuation.

3. A sleeve section according to claim 2, characterized in that the length of the rectangular base part is approximately 60–100 mm and the width approximately 25–40 mm.

4. A sleeve section according to claim 2, characterized in that the base part has a flap projecting from the other long side of the rectangle.

5. A sleeve section according to claim 2, characterized in that the sleeve is impregnated with a hygroscopic preparation.

* * * * *